US011230793B2

(12) United States Patent
McHugh et al.

(10) Patent No.: US 11,230,793 B2
(45) Date of Patent: Jan. 25, 2022

(54) MECHANICALLY-DRIVEN OSCILLATING FLOW AGITATION

(71) Applicant: Applied Materials, Inc., Santa Clara, CA (US)

(72) Inventors: Paul R. McHugh, Kalispell, MT (US); Gregory J. Wilson, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/064,785

(22) Filed: Oct. 7, 2020

(65) Prior Publication Data

US 2021/0102307 A1 Apr. 8, 2021

Related U.S. Application Data

(60) Provisional application No. 62/912,155, filed on Oct. 8, 2019.

(51) Int. Cl.

| | |
|---|---|
| ***C25D 21/10*** | (2006.01) |
| ***C25D 17/02*** | (2006.01) |
| ***C25D 5/08*** | (2006.01) |
| ***C25D 7/12*** | (2006.01) |
| ***C25D 17/00*** | (2006.01) |

(52) U.S. Cl.

CPC ..... *C25D 21/10* (2013.01); *C25D 5/08* (2013.01); *C25D 7/12* (2013.01); *C25D 17/001* (2013.01); *C25D 17/02* (2013.01)

(58) Field of Classification Search

CPC ..... C25D 21/10; C25D 5/08

See application file for complete search history.

(56) References Cited

U.S. PATENT DOCUMENTS

2013/0056361 A1* 3/2013 Kurashina ..... H01L 21/76879 205/101

FOREIGN PATENT DOCUMENTS

| | | | |
|---|---|---|---|
| JP | S637392 | A | 1/1988 |
| JP | H11-335895 | A | 12/1999 |
| JP | 2009-263758 | A | 11/2009 |
| WO | 2009-047045 | A2 | 4/2009 |

OTHER PUBLICATIONS

International Search Report and Written Opinion dated Jan. 29, 2021 in International Patent Application No. PCT/US2020/054494, 8 pages.

* cited by examiner

*Primary Examiner* — Ho-Sung Chung

(74) *Attorney, Agent, or Firm* — Kilpatrick Townsend & Stockton LLP

(57) ABSTRACT

Systems and methods for electroplating are described. The electroplating system may include a vessel configured to hold a first portion of a liquid electrolyte. The system may also include a substrate holder configured for holding a substrate in the vessel. The system may further include a first reservoir in fluid communication with the vessel. In addition, the system may include a second reservoir in fluid communication with the vessel. Furthermore, the system may include a first mechanism configured to expel a second portion of the liquid electrolyte from the first reservoir into the vessel. The system may also include a second mechanism configured to take in a third potion of the liquid electrolyte from the vessel into the second reservoir when the second portion of the liquid electrolyte is expelled from the first reservoir. Methods may include oscillating flow of the electrolyte within the vessel.

10 Claims, 10 Drawing Sheets

MECHANICALLY-DRIVEN OSCILLATING FLOW AGITATION

CROSS REFERENCES TO RELATED APPLICATIONS

This application claims the benefit of priority to U.S. Provisional Patent Application No. 62/912,155 filed Oct. 8, 2019, the contents of which are hereby incorporated by reference in their entirety for all purposes.

TECHNICAL FIELD

The present technology relates to electroplating systems and methods in semiconductor processing.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems caused during the metallization may create expensive waste substrates or wafers.

As characteristic dimensions of devices decrease and aspect ratios of structures increase, plating becomes more difficult. Plating may require higher flow strain rates to achieve high mass transfer for plating megapillars and other structures so that equipment throughput remains high. These high flow strain rates may not be uniform across the width of the substrate, which may result in plating non-uniformities. It becomes more difficult to provide uniform mass transfer across a large substrate (e.g., a 300 mm wafer) as the mass transfer rate increases.

Thus, there is a need for improved systems and methods that can be used to produce high quality devices and structures during plating at high plating rates necessitating high mass transfer and/or high strain rates. These and other needs are addressed by the present technology.

BRIEF SUMMARY

Embodiments of the present technology may involve oscillating flow across the wafer substrate during plating. The flow of the liquid electrolyte may include a uniform or substantially uniform strain rate near the wafer or other substrate. High strain rates may be achieved, allowing plating into high aspect vias, trenches, or other features. High strain rates can help improve the shape of features being plated on a substrate, enhance additive transport and metal ions into features, and enable higher plating rates. Uniform strain rates may also result in uniform plating across the wafer. Embodiments of the present technology may also simplify and/or reduce components in the system. Simplifying or reducing components in the system may result in improved electric field and current density uniformity. Simplification can also reduce equipment cost and improve reliability.

Embodiments of the present technology may include a system for electroplating. The electroplating system may include a vessel configured to hold a first portion of a liquid electrolyte. The system may also include a substrate holder configured for holding a substrate in the vessel. The system may further include a first reservoir in fluid communication with the vessel. In addition, the system may include a second reservoir in fluid communication with the vessel. Furthermore, the system may include a first mechanism configured to expel a second portion of the liquid electrolyte from the first reservoir into the vessel. The system may also include a second mechanism configured to take in a third portion of the liquid electrolyte from the vessel into the second reservoir when the second portion of the liquid electrolyte is expelled from the first reservoir.

Embodiments of the present technology may include a method of plating a substrate. The method may include contacting a substrate on a substrate holder in a vessel with an electrolyte that includes metal ions. The method may also include flowing a first portion of the electrolyte from a first reservoir into the vessel. The method may further include flowing the electrolyte across the substrate in a first direction. In addition, the method may include flowing a second portion of the electrolyte from a second reservoir into the vessel. Furthermore, the method may include flowing the electrolyte across the substrate in a second direction, which is opposite the first direction. The method may also include electrochemically plating metal onto the substrate while flowing the electrolyte in the first direction and while flowing the electrolyte in the second direction.

Embodiments of the present technology may include a method of plating a substrate. The method may include contacting a substrate on a substrate holder in a vessel with an electrolyte that includes metal ions. The method may also include flowing a first portion of the electrolyte from a first reservoir into the vessel. The method may further include flowing the electrolyte across the substrate in a first direction. In addition, the method may include flowing a second portion of the electrolyte from a second reservoir into the vessel. Furthermore, the method may include flowing the electrolyte across the substrate in a second direction, which is opposite the first direction. The method may include oscillating the flow of the electrolyte between the first direction and the second direction. The method may also include electrochemically plating metal onto the substrate while oscillating the flow of the electrolyte between the first direction and the second direction.

BRIEF DESCRIPTION OF THE DRAWINGS

A further understanding of the nature and advantages of the disclosed embodiments may be realized by reference to the remaining portions of the specification and the drawings.

DETAILED DESCRIPTION

Figure 1:
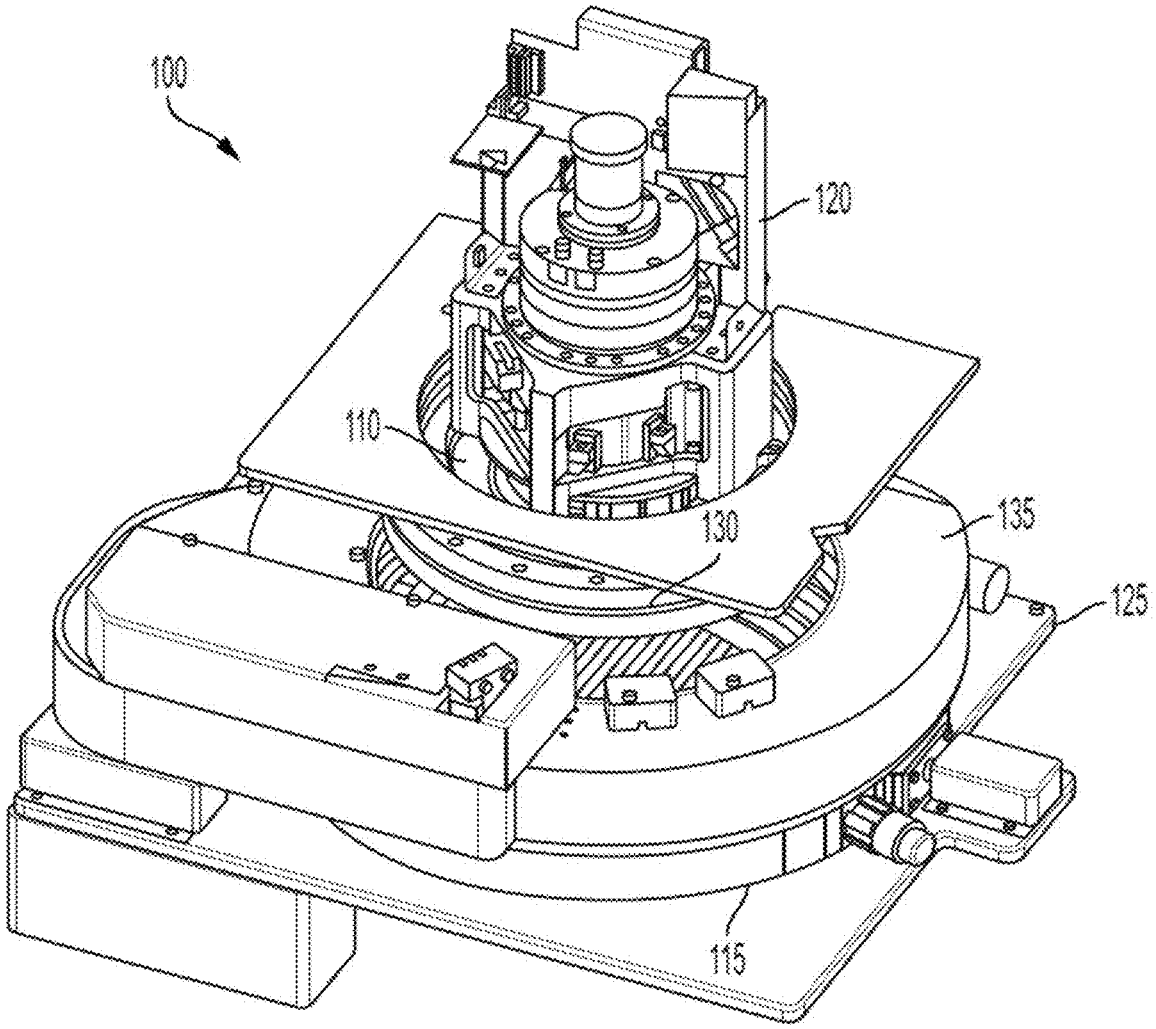
FIG. 1 shows a schematic perspective view of a chamber on which oscillating flow technology may be coupled according to some embodiments of the present technology.

Embodiments of the present technology may allow for uniform and high strain rates near the substrate resulting in more uniform plating of the substrate and/or faster plating rates. Other methods of electroplating to achieve high strain rates may include using a series of agitators near the substrate. The flow, however, may not be uniform and may have practical limits for the magnitude of the strain rate/agitation achievable. In addition, the agitators may introduce additional design complexity into the system. The number and shape of the agitators would have to be decided for a system. Furthermore, the agitators may act as a moving shield. Eliminating these agitators may result in better electric field and current density uniformity. Additionally, increasing the speed of the agitators may result in splashing and other flow non-uniformities.

Another method of electroplating to achieve high strain rates would be for a single directional cross flow near the substrate. This cross flow may involve high flow rates (e.g., 5-15 gpm) to achieve high strain rates. These high flow rates may tax tank and pumping systems and may increase operational and capital costs. A single-direction, fully developed channel flow is characterized by a parabolic velocity profile with the peak velocity at the center of the channel. In contrast, the velocity profile in an oscillating channel flow may change with time. Oftentimes the peak velocity occurs near the channel walls, which leads to higher wall strain rate values and improved within via mass-transfer.

Embodiments of the present technology include mechanisms (e.g., pistons or moving walls) to oscillate flow back and forth across the wafer. The flow may be across the entire length of the wafer. Embodiments may eliminate the use of a series of agitators (e.g., paddles) within the plating bath. Eliminating the agitators may also allow the gap in the vessel (i.e., vertical space above or below a substrate) to be reduced or may allow the gap to be limited to a certain range. The gap may be the space between the substrate and the virtual anode openings or current source, which may also include shields or other field shaping elements. Use of agitators may result in a larger gap because the agitator with a certain height must reside in this space. Consequently, electric field control may require placing shields or other field shaping elements both above and below the agitator. An oscillating channel flow performs well with a smaller gap, which may enable simplification of electric field control by placing all shields and other field shaping elements below and near the wafer. Smaller gaps may allow for simpler uniformity control. Piston driven oscillating shear flow may also enable higher flow strain rates than are possible with a series of agitators.

In addition, the mechanisms to oscillate flow back and forth across the system can create high flow strain rates without impacting the external plumbing system. For example, some illustrative examples of oscillating flows may be equivalent to over 50 gpm with a single movement of the mechanism to expel electrolyte (e.g., a single stroke of a piston). The velocity profile with an oscillating system may have the maximum velocity not located in the vertical center of the channel, but rather closer to the substrate. This velocity profile would result in a higher strain rate compared to a velocity profile with the same maximum velocity but in the vertical center of the vessel.

FIG. 1 shows a schematic isometric view of an electroplating system 100 upon which the oscillating flow methods and systems may applied according to embodiments of the present technology. Electroplating system 100 illustrates an exemplary electroplating system including a system head 110 and a bowl 115. During electroplating operations, a wafer may be clamped to the system head 110, inverted, and extended into bowl 115 to perform an electroplating operation. Electroplating system 100 may include a head lifter 120, which may be configured to both raise and rotate the head 110, or otherwise move or position the head within the system including tilting operations. The head and bowl may be attached to a deck plate 125 or other structure that may be part of a larger system incorporating multiple electroplating systems 100, and which may share electrolyte and other materials.

A rotor may allow a substrate clamped to the head to be rotated within the bowl, or outside the bowl in different operations. The rotor may include a contact ring, which may provide the conductive contact with the substrate. A seal 130 discussed further below may be connected with the head. Seal 130 may include a chucked wafer to be processed. An exemplary in situ rinse system 135 is also illustrated with the system 100.

Figure 2:
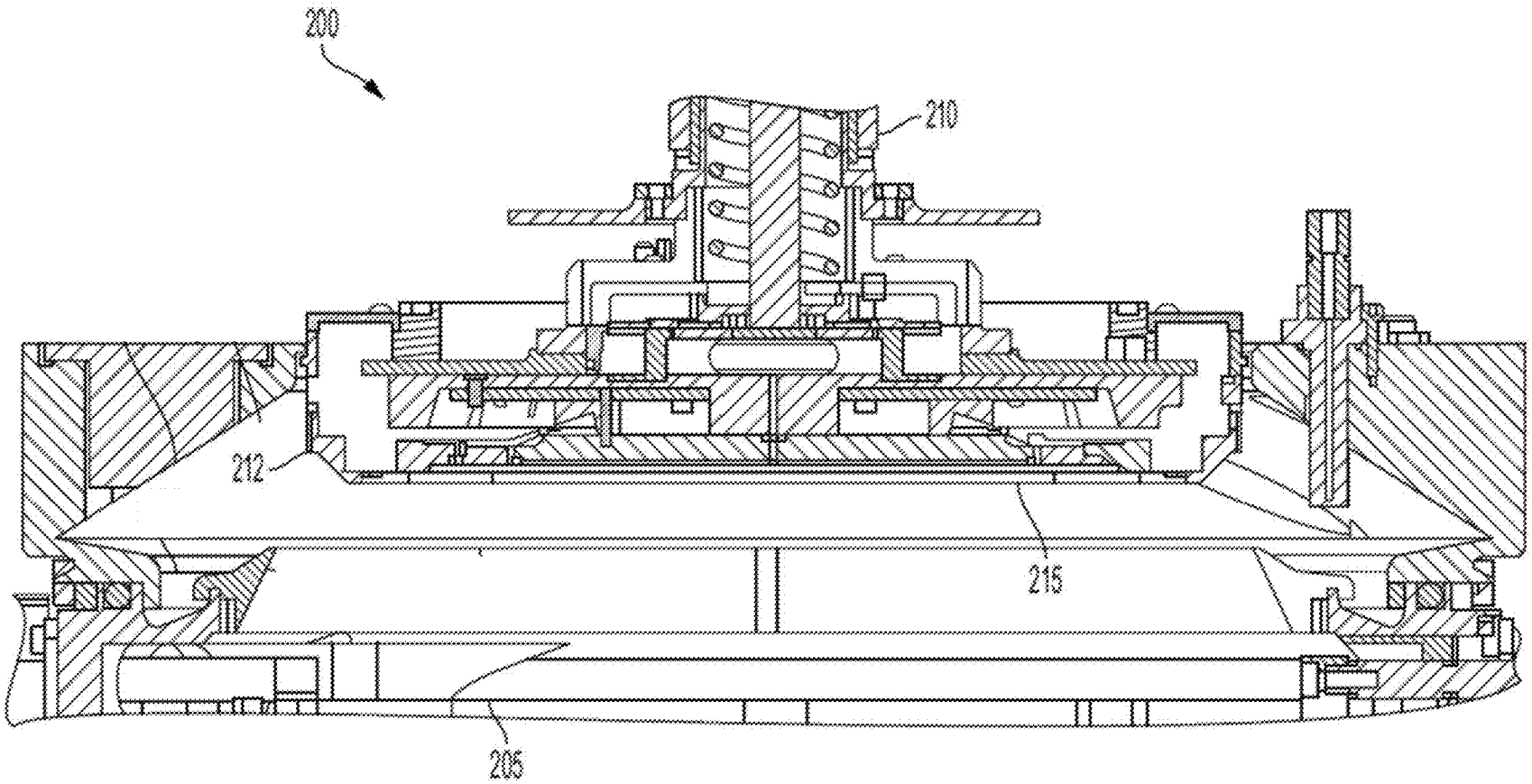
FIG. 2 shows a partial cross-sectional view of a chamber according to some embodiments of the present technology.

Turning to FIG. 2 is shown a partial cross-sectional view of a chamber including aspects of an electroplating apparatus 200 according to some embodiments of the present technology. The electroplating apparatus 200 may be incorporated with an electroplating system, including system 100 described above. As illustrated in FIG. 2, a plating bath vessel 205 of an electroplating system is shown along with a head 210 having a substrate 215 coupled with the head. The substrate may be coupled with a seal 212 incorporated on the head in some embodiments. Electroplating apparatus 200 may additionally one or more nozzles used to deliver fluids to or towards the substrate 215 or the head 210.

FIG. 1 and FIG. 2 provide examples of electroplating systems. Embodiments of the present technology can be applied to these electroplating systems and other electroplating systems. Embodiments of the present technology may be applied to the Applied Materials® Nokota™ electrochemical deposition system. Embodiments of the present technology may be used in combination with any components of FIG. 1 or FIG. 2 and may omit any combination of components of FIG. 1 and FIG. 2.

I. Example System

Figure 3A:
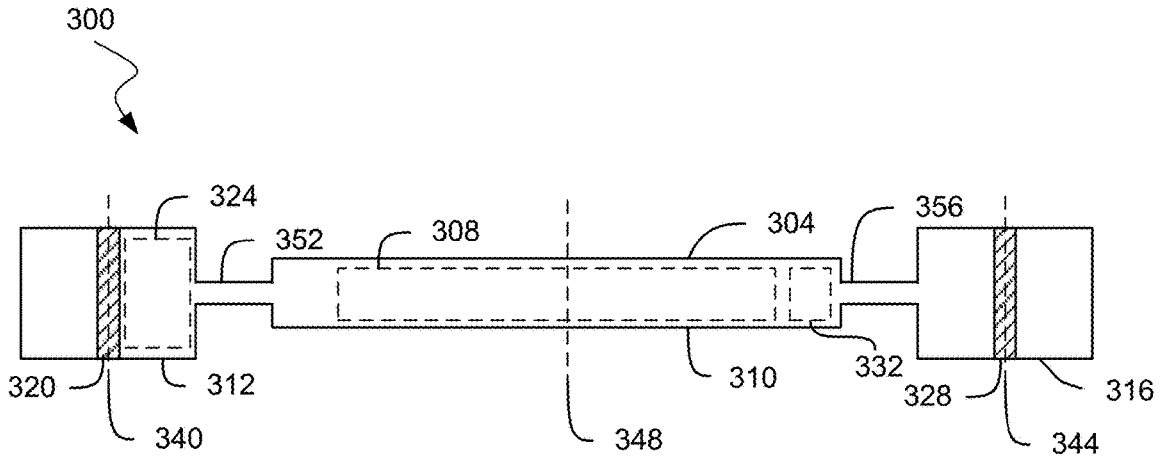
FIGS. 3A, 3B, 3C, and 3D illustrate a system for electroplating according to embodiments of the present technology.

The electroplating systems of FIG. 1 and FIG. 2 may be modified to include a system with oscillating shear flow. FIG. 3A shows an example system 300 for electroplating, which may be used in combination with either of FIG. 1 or FIG. 2. System 300 includes a vessel 304 configured to hold a first portion 308 of a liquid electrolyte. Vessel 304 may be bowl 115 in FIG. 1 or plating bath vessel 205 in FIG. 2. The electroplating of the substrate may occur in vessel 304. System 300 may also include a substrate holder configured for holding a substrate in vessel 304. The substrate may be held as described in FIG. 1 or FIG. 2. Vessel 304 may include a channel floor 310, which may be on the opposite side of a channel as the substrate holder. System 300 may further include a first reservoir 312 in fluid communication with vessel 304. System 300 may also include a second reservoir 316 in fluid communication with vessel 304. First reservoir 312 may be in fluid communication with second reservoir 316. System 300 may include a first mechanism 320 configured to expel a second portion 324 of the liquid electrolyte from first reservoir 312 into vessel 304. System 300 may also include a second mechanism 328 configured to take in a third portion 332 of the liquid electrolyte from vessel 304 into second reservoir 316 when second portion 324 is expelled from first reservoir 312.

First portion 308, second portion 324, and third portion 332 are simplified to illustrate how the liquid electrolyte may be moved between first reservoir 312, second reservoir 316, and vessel 304. Flow dynamics are more complicated than the illustration in FIG. 3A. The illustrated portions of the liquid electrolyte would not necessarily be moved between the different locations. The volume of first reservoir 312 may be greater than or equal to volume of vessel 304. As a result of this volume relationship, one move of first mechanism 320 to fully expel first reservoir 312 may result in a full exchange of the electrolyte within vessel 304. Similarly, the volume of second reservoir 316 may be greater than or equal to volume of vessel 304. The volume of first reservoir 312 may equal the volume of second reservoir 316.

Second mechanism 328 may be configured to expel third portion 332 of the liquid electrolyte from second reservoir 316 into vessel 304. First mechanism 320 may be configured to take in a fourth portion 336 of the liquid electrolyte from vessel 304 into first reservoir 312 when third portion 332 of the liquid electrolyte is expelled from second reservoir 316.

First mechanism 320 may be configured to oscillate between expelling and taking in liquid electrolyte from first reservoir 312. Second mechanism 328 may be configured to oscillate between expelling and taking in liquid electrolyte from second reservoir 316.

First mechanism 320 may include a first sliding element. The first sliding element may be configured to move within first reservoir 312. Second mechanism 328 may include a second sliding element. The second sliding element may be configured to move within second reservoir 316. First mechanism 320 or second mechanism 328 may be a piston. The mechanism may be any combination of volume expansion and contraction devices to shuffle flow back and forth across the chamber or substrate. For example, moving endwalls with bellows could be employed rather than sliding elements.

A cross-sectional area of the first sliding element may be equal or substantially equal to a cross-sectional area of a first space defined by first reservoir 312. The cross-sectional area of the first sliding element and the cross-sectional area of the first space may both be areas in a single plane 340. For example, the first space defined by the first reservoir may be a cylinder or cylindrical in shape. The first sliding element may be a circle or circular in shape. The circle may move within the cylinder. Seals or o-rings may be present on the first sliding element and between the first sliding element and the first reservoir to allow for movement of the first sliding element to create a pressure gradient. Similarly, the cross-sectional area of the second sliding element may be equal to the cross-sectional area of a second space defined by second reservoir 316. The cross-sectional area of the second sliding element may be analogous to any cross-sectional area of the first sliding element, and the cross-sectional area of the second space may be analogous to any cross-sectional area of the first space. First mechanism 320 and second mechanism 328 may be sliding elements that move within rectangular cross sections similar to vessel 304 or larger.

Figure 3B:
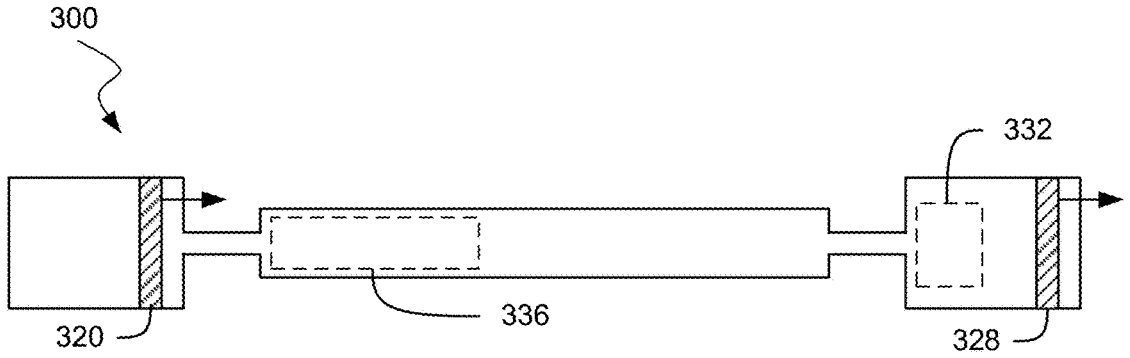

First mechanism 320 may be configured to expel second portion 324 of the liquid electrolyte in a direction. The direction may be from first reservoir 312 into vessel 304. For example, in FIG. 3B, the direction is illustrated as left to right. First mechanism 320 may be configured to move in the direction to expel second portion 324 of the liquid electrolyte. Second mechanism 328 may be configured to move in the same direction to take in third portion 332 of the liquid electrolyte. First mechanism 320 and second mechanism 328 may move in sync.

Figure 3C:
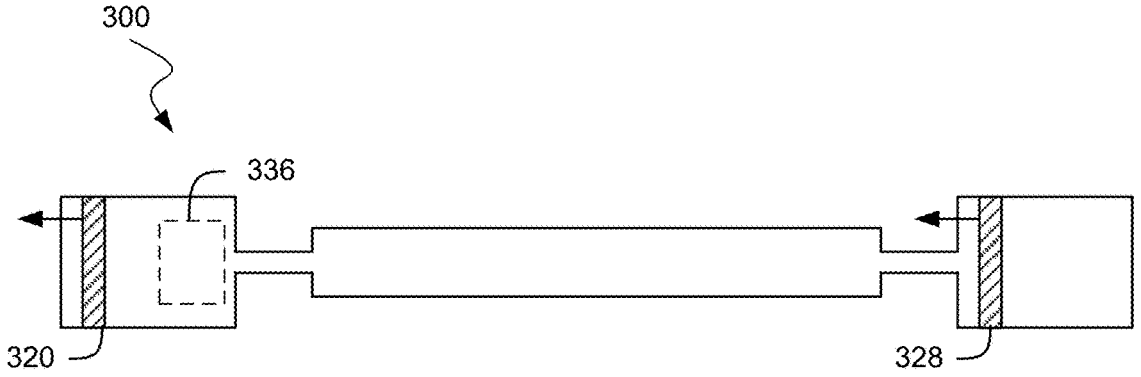

FIG. 3C shows movement of first mechanism 320 and second mechanism 328 in the opposite direction when second mechanism 328 expels liquid electrolyte and first mechanism 320 takes in liquid electrolyte. First mechanism 320 takes in fourth portion 336 of the liquid electrolyte. In FIG. 3C, the direction is shown as right to left. The movement of first mechanism 320 and second mechanism 328 may cycle through these figures, such that first mechanism 320 and second mechanism 328 are in the positions in FIG. 3A and then FIG. 3B following FIG. 3C.

Figure 3D:
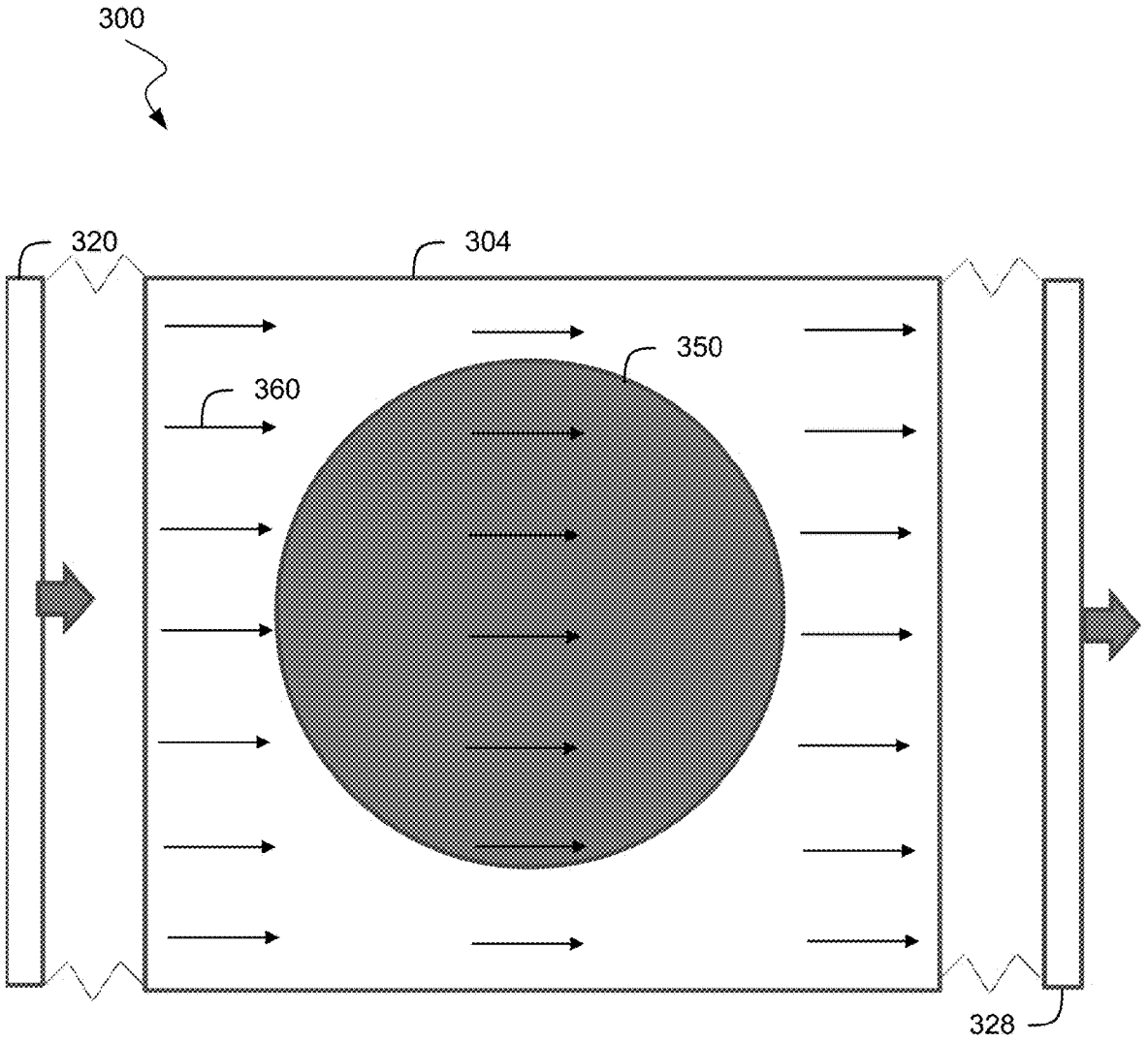

FIG. 3D shows a top view of system 300. Substrate 350 is shown in the middle of vessel 304. First mechanism 320 and second mechanism 328 are shown connected to bellows. First mechanism 320 and second mechanism 328 may be moving endwalls of a channel. Vessel 304 may be considered as including a flow channel with substrate 350 forming an upper wall and the floor of the vessel (channel floor 310) forming the lower wall. Arrows, such as arrow 360, indicate the direction of flow within vessel 304. The flow direction across the wafer is shown as substantially in only one direction, regardless of the position (e.g., top of FIG. 3D to bottom of FIG. 3D) on the wafer. This flow may be a result of a wide channel for the flow or several channels from first mechanism 320 across the diameter of the wafer. This directional flow across the wafer may not result from a single channel less than the diameter of the wafer.

Figure 4A:
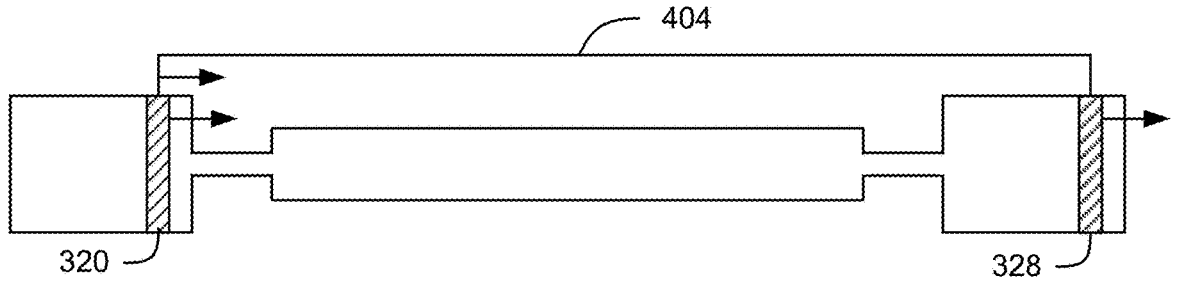
FIGS. 4A, 4B, 4C, 4D, and 4E show systems for electroplating according to embodiments of the present technology.

First mechanism 320 may be connected to second mechanism 328 such that movement by first mechanism 320 results in movement by second mechanism 328. For example, a rigid bar 404 in FIG. 4A may physically connect first mechanism 320 to second mechanism 328. First mechanism 320 may only move when second mechanism 328 moves. Rigid bar 404 may be in mechanical communication with an actuator, motor (e.g., a stepper motor, linear motor, rotary motor with linkages, pneumatic), spring, or other suitable device. In some embodiments, first mechanism 320 may not be physically connected to second mechanism 328. In embodiments, if system 300 is sealed, one of first mechanism 320 and second mechanism 328 may be the driver and the other mechanism would be the follower, driven by the internal pressure in the vessel created by first mechanism 320. A processor may be configured to control the movement of first mechanism 320. A processor may be configured to control the movement of second mechanism 328. Movement of the first mechanism or the second mechanism may be by an actuator, a motor (e.g., a stepper motor), spring, or other suitable device. In some embodiments, first mechanism 320 may move independently of second mechanism 328. For example, second mechanism 328 may move in the same direction as first mechanism 320 slightly before or after first mechanism 320 moves. A delay between the movements of the mechanisms may be used to optimize flow characteristics. If system 300 is sealed, movements of the mechanisms may be synchronized.

System 300 may include no mechanisms configured to agitate the liquid electrolyte located within vessel 304. For example, system 300 may not include paddles that move to agitate the liquid electrolyte within vessel 304, including in the area where the substrate is processed. The area where the substrate is processed may include a cylinder or other geometry circumscribing the substrate within vessel 304. For example, the area may exclude portions of vessel 304 outside a cylinder-like volume extending from the edge of the substrate. The processing area may exclude portions of the electrolyte where ions are too far from the substrate to affect plating of the substrate. First mechanism 320 and second mechanism 328 may be located outside the edge of the substrate.

System 300 may be configured such that when first mechanism 320 expels second portion 324 from first reservoir 312 into vessel 304, no portion of the liquid electrolyte exits vessel 304 other than to second reservoir 316. Similarly, system 300 may be configured such that when second mechanism 328 expels third portion 332 from second reservoir 316 into vessel 304, no portion of the liquid electrolyte exits vessel 304 other than to first reservoir 312. For example, vessel 304, first reservoir 312, and second reservoir 316 may be sealed so that no liquid may leak out of space contained by these components during expulsion of liquid electrolyte from either reservoir. The floor of vessel 304 (e.g., channel floor 310) may be solid and not porous. Channel floor 310 may not allow liquid to pass through. However, channel floor 310 may allow ions to pass through from an electrolyte plenum below the floor in order to allow ionic current to pass through the floor. Channel floor 310 may include an ionic membrane and may be made of Nafion. Channel floor 310 may include a rigid supporting structure or structures to immobilize the ionic membrane so that the ionic membrane does not disturb the oscillating flow. The rigid supporting structure may be a diffuser plate (e.g., a perforated plate made from a non-conducting material). The ionic membrane may be sandwiched between two rigid supporting structures.

The geometries of first reservoir 312, second reservoir 316, and vessel 304 may be configured so that movement of first mechanism 320 or second mechanism 328 provides a suitable velocity of the liquid electrolyte within vessel 304. The cross-sectional area of the reservoirs may be larger than the cross-sectional area of vessel 304 so that the velocity of the electrolyte will be faster in vessel 304 than in the reservoirs. First reservoir 312 may be characterized by a first cross-sectional area orthogonal to a plane including the substrate when the substrate is in the substrate holder. For example, the first cross-sectional area may be measured along plane 340. Second reservoir 316 may be characterized by a second cross-sectional area orthogonal to the plane including the substrate. For example, the second cross-sectional area may be measured along plane 344. Vessel 304 may be characterized by a third cross-sectional area orthogonal to the plane including the substrate. For example, the third cross-sectional area may be measured along plane 348. The third cross-sectional area may be less than the first cross-sectional area, and the third cross-sectional area may be less than the second cross-sectional area. The ratio of the first or second cross-sectional area to the third cross-sectional area may be from 1 to 1.5, from 1.5 to 2, from 2 to 5, from 5 to 10, or greater than 10. Ratios of areas and stroke length can be selected so as to drive fluid from first reservoir across vessel to second reservoir.

First reservoir 312 and second reservoir 316 may have equal or greater volumes than vessel 304. The ratio of the volume of first reservoir 312 or second reservoir 316 to the volume of vessel 304 may be from 1 to 1.5, from 1.5 to 2, from 2 to 5, from 5 to 10, or greater than 10. First reservoir 312 and second reservoir 316 may have a gap (e.g., the height in FIG. 3A) greater than the wafer gap of vessel 304. The wafer gap (e.g., distance between the wafer at the top of the vessel and floor of vessel) may be from 1 to 10 mm, including from 1 to 5 mm and from 5 to 10 mm.

FIG. 3A shows a first channel 352 between first reservoir 312 and vessel 304 and a second channel 356 between second reservoir 316 and vessel 304. The channels may not be straight and may be curved. In some embodiments, system 300 may not include channels, with the reservoirs being directly connected to vessel 304. The effect of first mechanism 320 and second mechanism 328 moving would be similar to sidewalls of a closed vessel (i.e., without reservoirs) moving. Although FIG. 3A shows first channel 352 to be narrower than vessel 304, first channel 352 may be the same width or wider than vessel 304. First channel 352 may have the same cross-sectional area as vessel 304. Additional details of embodiments of first channel 352 are discussed in FIG. 4D and FIG. 4E below.

Figure 4B:
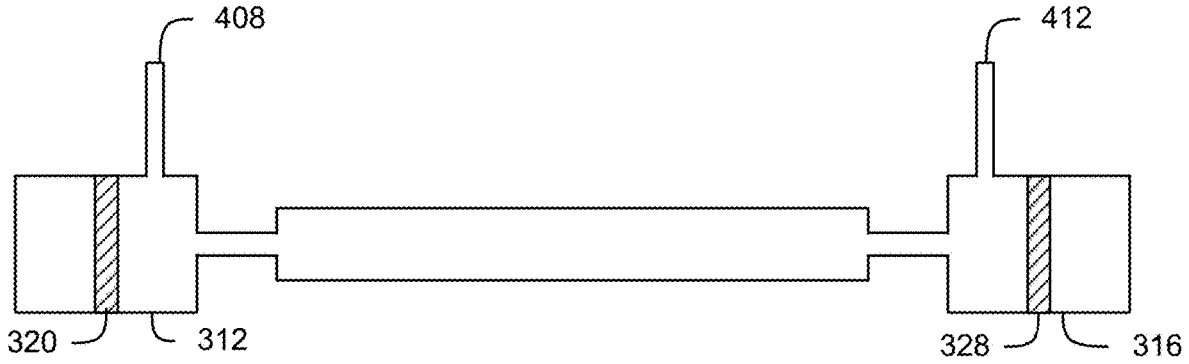

FIG. 4B shows a system including a liquid electrolyte inlet 408 and a liquid electrolyte outlet 412. Liquid electrolyte inlet 408 may be configured to deliver liquid electrolyte to first reservoir 312. Delivering liquid electrolyte to first reservoir 312 may be when first mechanism 320 is expelling liquid electrolyte from first reservoir 312. Liquid electrolyte outlet 412 may be configured to remove liquid electrolyte from second reservoir 316. Removing liquid electrolyte from second reservoir 316 may be when second mechanism 328 is taking in liquid electrolyte into second reservoir 316. Liquid electrolyte inlet 408 and liquid electrolyte outlet 412 may at times be sealed from the reservoirs to prevent any liquid electrolyte from entering or exiting the reservoirs and vessel. A purpose of inlet 408 and outlet 412 may be to refresh the electrolyte (additives and ions) processing the substrate. Inlet 408 and outlet 412 can also be used to set a reference pressure of the system.

Figure 4C:
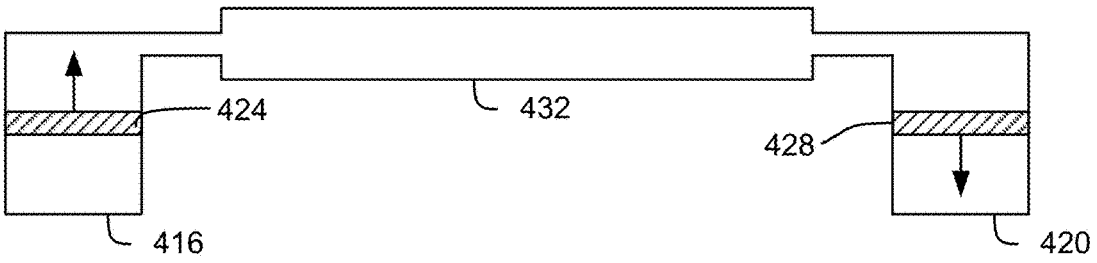

FIG. 4C shows other embodiments of reservoirs and mechanisms. First reservoir 416 and second reservoir 420 are oriented such that their respective longitudinal axes are perpendicular to the flow of liquid electrolyte through the vessel. First mechanism 424 and second mechanism 428 may move in a direction perpendicular to the flow of liquid electrolyte through the vessel. In other embodiments, first reservoir and second reservoir and their respective mechanisms may be oriented at angles between parallel and perpendicular to the flow of liquid electrolyte through the vessel.

The floor of the vessel may include a diffuser. For example, floor 432 in FIG. 4C may include a membrane and a diffuser. The membrane and diffuser may allow for electric current (e.g., ions) to pass through without bulk fluid transport. Dividers may be included to restrict pressure communication and flow from a first mechanism to a second mechanism. The dividers are described in FIG. 9 below.

Figure 4D:
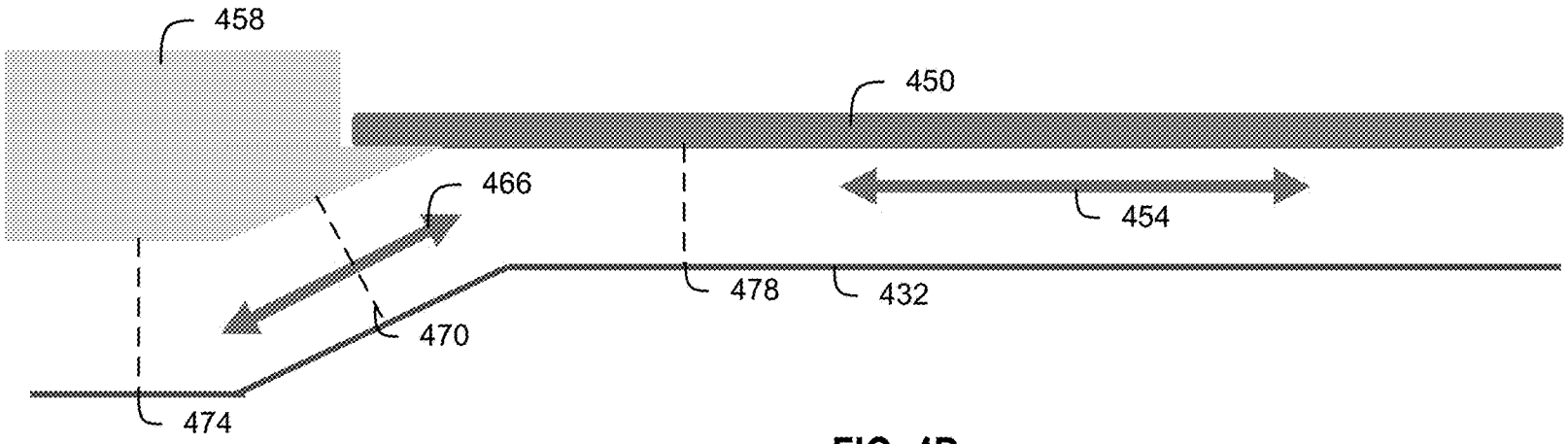
Figure 4E:
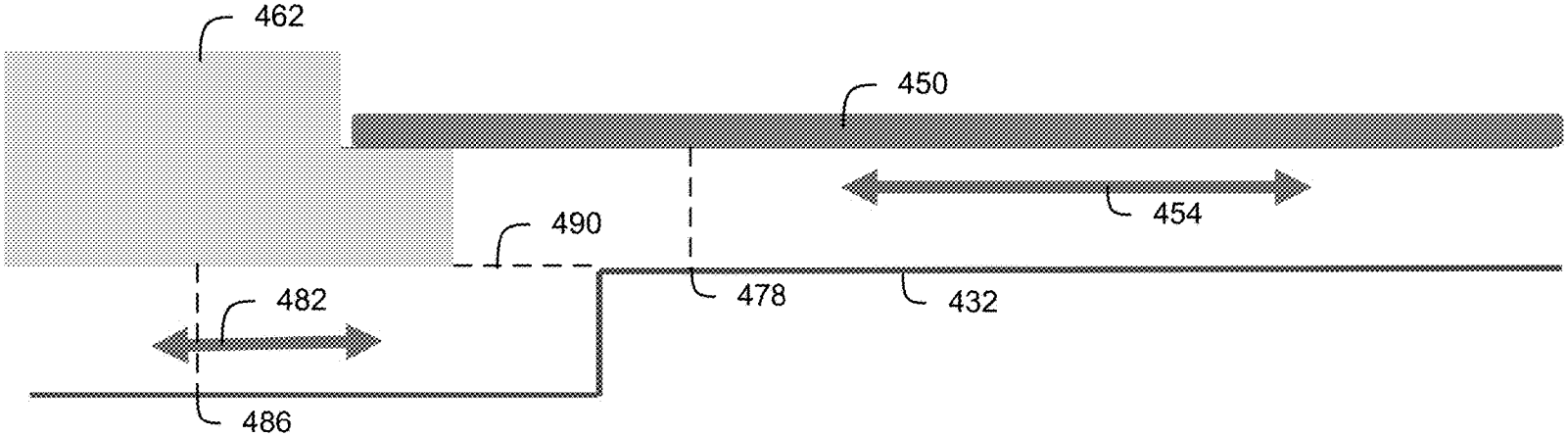

FIG. 4D and FIG. 4E show the configuration of the flow channel from a reservoir to a substrate 450. In these diagrams, the first reservoir is on the left side of each figure. An oscillating flow 454 is present under substrate 450. FIG. 4D has an edge seal 458. Edge seal 458 contacts the front side of substrate 450 and creates a liquid-tight seal. Edge seal 458 may include an o-ring, which may be made of an elastomer, contacting substrate 450. FIG. 4E has an edge seal 462, which has a different geometry than edge seal 458 but functions the same as edge seal 458. As a result of contacting substrate 450, neither edge seal 458 nor edge seal 462 is flush with substrate 450. Oscillating flow 454 may not continue in a straight line under the edge seals.

The cross-sectional area underneath the edge seals and perpendicular to the flow underneath the edge seal may be substantially equal. In FIG. 4D, an oscillating flow 466 may be under edge seal 458. Oscillating flow 466 may be parallel to the portion of edge seal 458 closest to oscillating flow 466. A cross-sectional area of the channel through line 470 may be orthogonal to oscillating flow 466. A cross-sectional area of the channel through line 474 may be orthogonal to oscillating flow under edge seal 458. The cross-sectional area of the channel through line 470 may be equal to cross-sectional area of the channel through line 474. Maintaining a constant cross-sectional area in the channel may reduce flow separations and flow jets formed in either direction of the oscillating flow. For example, the contour of the channel should not reduce flow separations and flow jets in one direction while creating or not reducing flow separations and flow jets in the opposite direction. A cross-sectional area of the channel through line 478 may be orthogonal to oscillating flow 454. The cross-sectional area of the channel through line 478 may be equal to at least one of the cross-sectional area of the channel through line 474 or through line 478.

The cross-sectional areas of the flow channel may be kept constant for different edge seal geometries. For example, in FIG. 4E, an oscillating flow 482 may be under edge seal 462. Oscillating flow 482 may be parallel to the portion of edge seal 462 closest to oscillating flow 482. A cross-sectional area of the channel through line 486 may be orthogonal to oscillating flow 482. A cross-sectional area of the channel through line 490 may be orthogonal to the oscillating flow as the flow transitions from oscillating flow 482 to oscillating flow 454. The cross-sectional area of the channel through line 486 may be equal to cross-sectional area of the channel through line 490. A cross-sectional area of the channel through line 478 may be orthogonal to oscillating flow 454. The cross-sectional area of the channel through line 478 may be equal to at least one of the cross-sectional area of the channel through line 486 or through line 490.

The vessel of the electroplating system may include a seal configured to contact the outer edge of the substrate in the substrate holder. The outer edge may be the circumference of the substrate. A first section of the vessel may include the seal and may be between the substrate holder and the first reservoir. A second section of the vessel may include the seal and may be between the substrate holder and the second reservoir. A third section of the vessel may include a floor opposite the substrate holder. The floor in the third section may be substantially flat. For example, floor 432 is substantially flat opposite substrate 450. The third section of the vessel may be between the first section and the second section of the vessel. The third section of the vessel may not include the portion of the substrate contacting the seal.

The first section of the vessel may include a first channel. The first channel may be first channel 352 in FIG. 3A. The first channel may be configured such that the cross-sectional area of the first channel orthogonal to flow through the first channel may be constant. In some embodiments, the cross-sectional area may vary no more than 5%, 10%, 15%, or 20%. The flow through the first channel may represent the average direction of flow in a certain section of the first channel. The floor in the first section of the vessel may be contoured to be parallel to sides of the seal in the first section of the vessel. The cross-sectional area of the first channel may be within 0%, 5%, 10%, 15%, or 20% of the cross-sectional area of a channel in the third section of the vessel.

Similar to the first section of the vessel, the second section of the vessel may include a second channel. The second channel may be configured such that the cross-sectional area of the second channel orthogonal to flow through the second channel may be constant. In some embodiments, the cross-sectional area may vary no more than 5%, 10%, 15%, or 20%. The flow through the first channel may represent the average direction of flow in a certain section of the first channel. The floor in the second section of the vessel may be contoured to be parallel to sides of the seal in the second section of the vessel. The cross-sectional area of the second channel may be within 0%, 5%, 10%, 15%, or 20% of the cross-sectional area of a channel in the third section of the vessel.

II. Example Method

Figure 5:
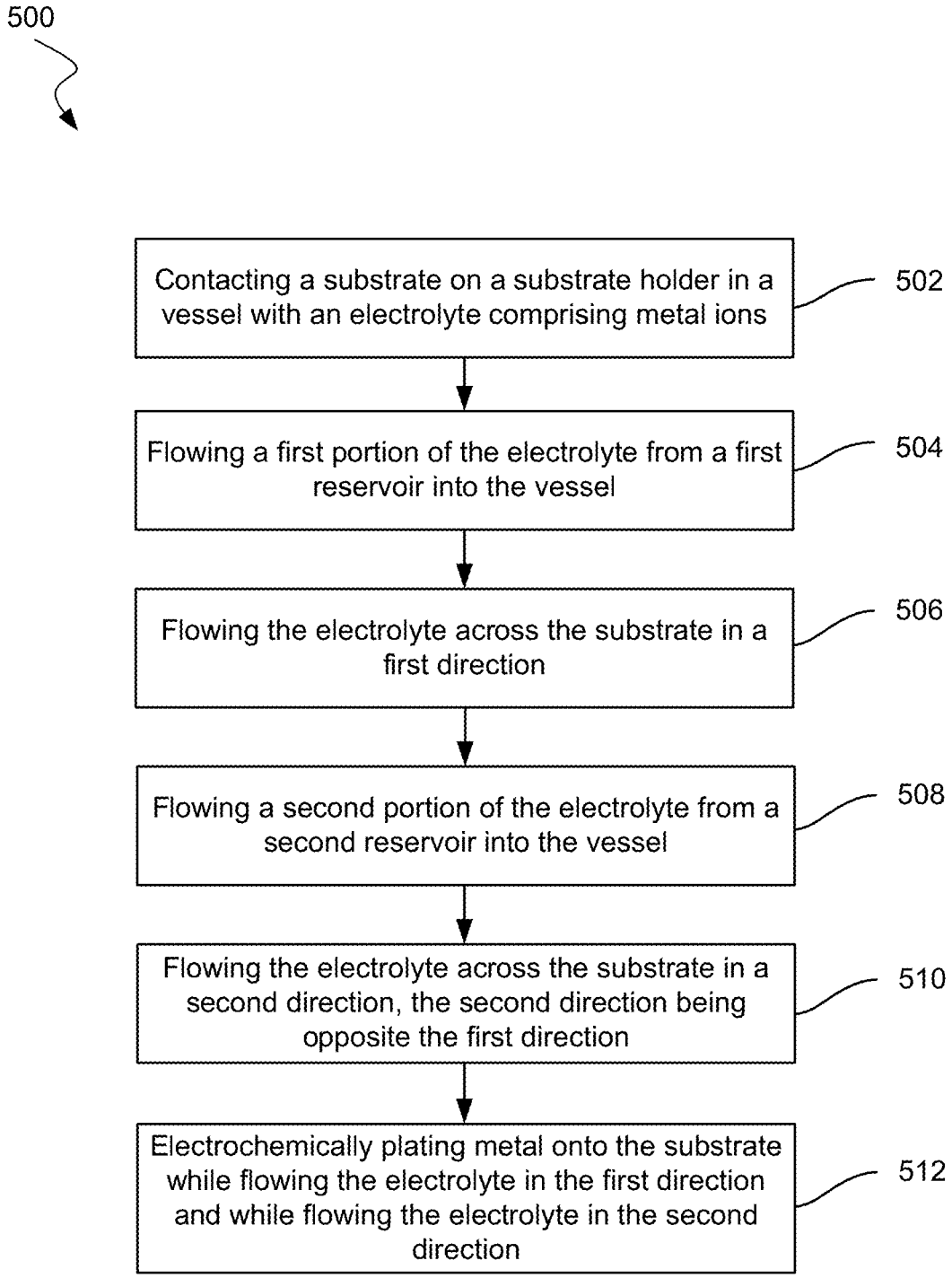
FIG. 5 shows a method of electroplating according to embodiments of the present technology.

FIG. 5 shows a method 500 of plating a substrate. Method 500 may include using any system described herein.

At block 502, method 500 may include contacting a substrate on a substrate holder in a vessel with an electrolyte comprising metal ions. The vessel, substrate, substrate holder, and electrolyte may be any described herein. The substrate may be a wafer, including a silicon wafer or a silicon-on-insulator wafer. The wafer may be prepared for an electroplating process. For example, the wafer may include a metal layer with a patterned photoresist covering.

At block 504, method 500 may include flowing a first portion of the electrolyte from a first reservoir into the vessel. The first reservoir may be any first reservoir described herein. The flow of the first portion of the electrolyte may be a result of a mechanism moving within the reservoir. The mechanism may be any mechanism described herein.

At block 506, method 500 may include flowing the electrolyte across the substrate in a first direction. The first direction may be from the first reservoir to the vessel. The flow of the electrolyte across the substrate may be a result of flowing a first portion of the electrolyte from the first reservoir into the vessel. The velocity of the flow in the first direction may be from 0.01 to 0.1 m/s, 0.1 to 02 m/s, 0.2 to 0.5 m/s, 0.5 to 0.8 m/s, 0.8 to 1.0 m/s, 1.0 to 5.0 m/s, 5.0 to 10 m/s, or over 10 m/s. The volumetric flow rate may be from 1 to 5 gpm, 5 to 10 gpm, 10 to 15 gpm, 15 to 20 gpm, or over 20 gpm. The volumetric flow rate may be the flow rate for one full movement of the mechanism within the first reservoir in the first direction. For example, the volumetric flow rate may be for one stroke of a piston.

At block 508, method 500 may include flowing a second portion of the electrolyte from a second reservoir into the vessel. The second reservoir may be any second reservoir described herein. The flow of the second portion may be a result of a mechanism moving within the second reservoir. The mechanism may be any described herein.

At block 510, method 500 may include flowing the electrolyte across the substrate in a second direction. The second direction may be opposite the first direction. For example, the second direction may be from the vessel to the first reservoir or from the second reservoir to the vessel. The flow across the substrate in a second direction may result from flowing the second portion of the electrolyte from the second reservoir into the vessel. The magnitude of the velocities and volumetric flow rates for the flow in the second direction may be the same as for the first direction.

Method 500 may include oscillating the flow between the first direction and the second direction. Oscillating the flow may be symmetrical between the first direction and the second direction. For instance, the first mechanism may move back and forth between the same two points. The second mechanism also may move back and forth between a different set of two points. The first mechanism may move by the same amount as the second mechanism. The oscillating may be at a frequency from 1 to 2 Hz, 2 to 4 Hz, 4 to 6 Hz, 6 to 8 Hz, 8 to 10 Hz, 10 to 15 Hz, 15 to 20 Hz, or over 20 Hz.

Method 500 may include charging the vessel to a pressure above ambient in order to avoid negative pressures that may bring in contaminants from outside the vessel or subject the substrate to undesired pressure differentials. A positive pressure may be maintained on the substrate and membrane (channel floor).

At block 512, method 500 may include electrochemically plating metal onto the substrate while flowing the electrolyte in the first direction and while flowing the electrolyte in the second direction. In embodiments, the flow may oscillate for the entire duration of the electroplating, which may be on the order of minutes. In some embodiments, the flow may oscillate for only a portion of the entire duration of the electroplating, including less than or equal to 10%, 20%, 30%, 40%, 50%, 60%, 70%, 80%, or 90% of the duration of the electroplating. The flow may oscillate at the beginning, middle, or end of the electroplating process.

The strain rate of the electrolyte may be uniform or substantially uniform when flowing the electrolyte across the substrate in the first direction or when flowing the electrolyte across the substrate in the second direction. The strain rate of electrolyte in the area where the substrate is processed may be within 5%, 10%, or 15% of the average strain rate at a particular instant or throughout the duration of the processing. The strain rate may be in a range from 200/s to 10,000/s, including from 200/s to 3,000/s, 3,000/s to 5,000/s, 5,000/s to 7,000/s, or 7,000/s to 10,000/s.

Method 500 may include rotating the substrate holder and the substrate. The substrate holder and substrate may be rotated when there is little or no flow across the substrate. The substrate may not be removed from contact with the electrolyte during rotation. The substrate may be rotated multiple times during a plating operation.

Method 500 may include removing the substrate from contact with the electrolyte.

III. Results

Figure 6:
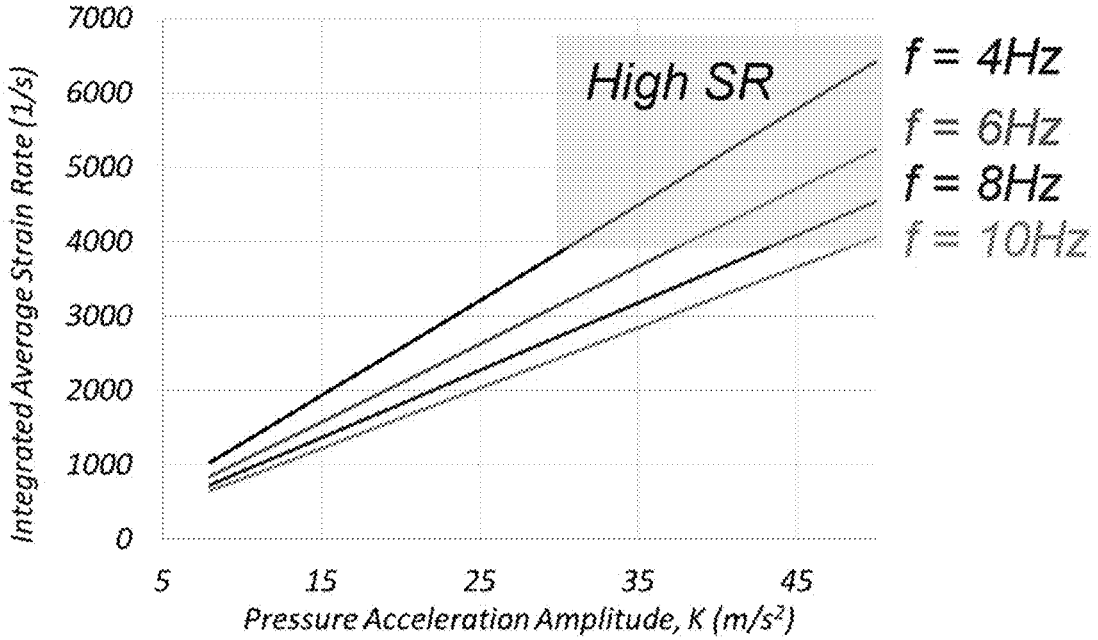
FIG. 6 shows a graph of strain rate versus pressure acceleration amplitude according to embodiments of the present technology.

Methods and systems described herein were simulated or calculated using the Navier-Stokes equations. FIG. 6 shows the results of an analytical model for the integrated average strain rate versus the pressure acceleration amplitude ($m/s^2$) for a sinusoidal oscillation motion. The pressure acceleration is the amplitude of the pressure gradient induced to create flow across a substrate. FIG. 6 shows that for a larger amplitude, the average strain rate increases. In addition, a higher frequency results in a lower strain rate for a fixed pressure amplitude. Strain rate in a parallel flow system can be defined as the gradient of the parallel velocity normal to the wall. FIG. 6 points out that large pressure amplitudes may be needed to achieve high strain rates.

Figure 7:
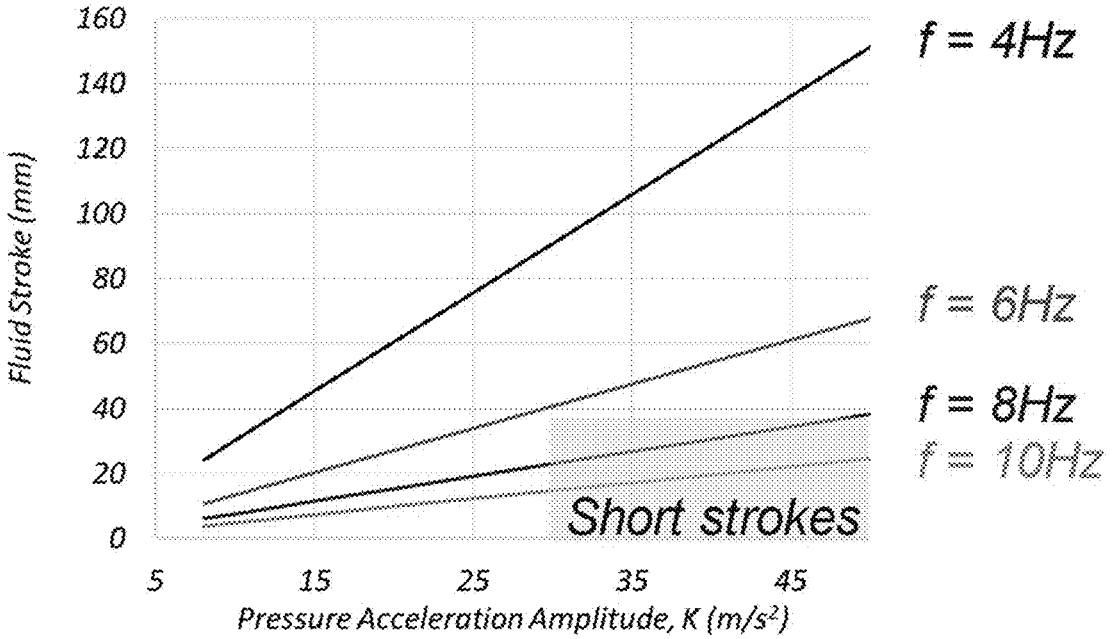
FIG. 7 shows a graph of fluid stroke and pressure acceleration amplitude according to embodiments of the present technology.

FIG. 7 shows the fluid stroke (mm) required for a certain pressure acceleration amplitude based on an analytical model. For a given pressure acceleration amplitude, a shorter stroke at a higher frequency is equivalent to a longer stroke at a lower frequency. FIG. 7 shows that at high pressure amplitude values, high frequencies may be needed to enable practical fluid strokes.

Figure 8A:
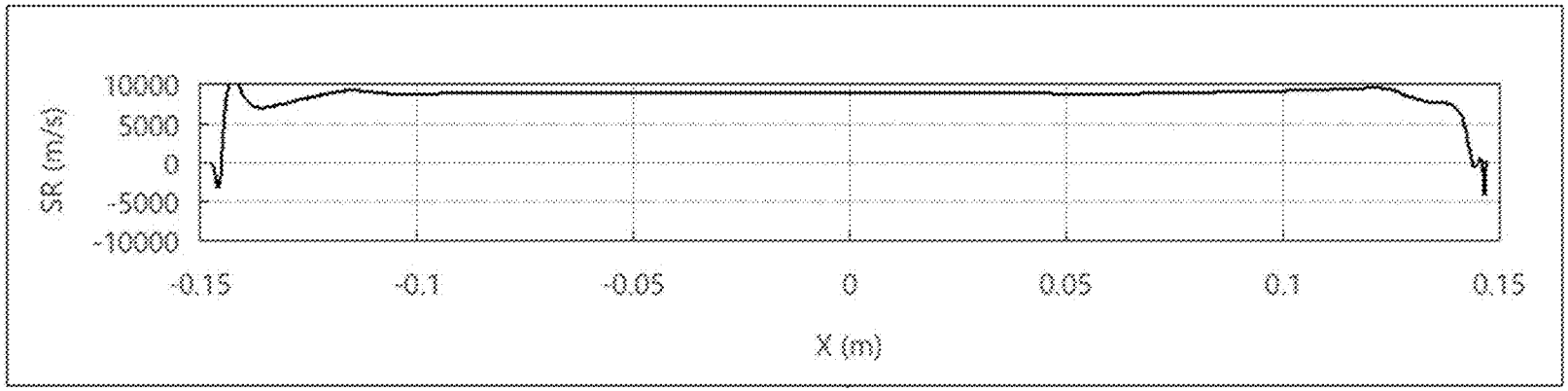
FIGS. 8A and 8B show graphs of flow characteristics in a vessel according to embodiments of the present technology.
Figure 8B:
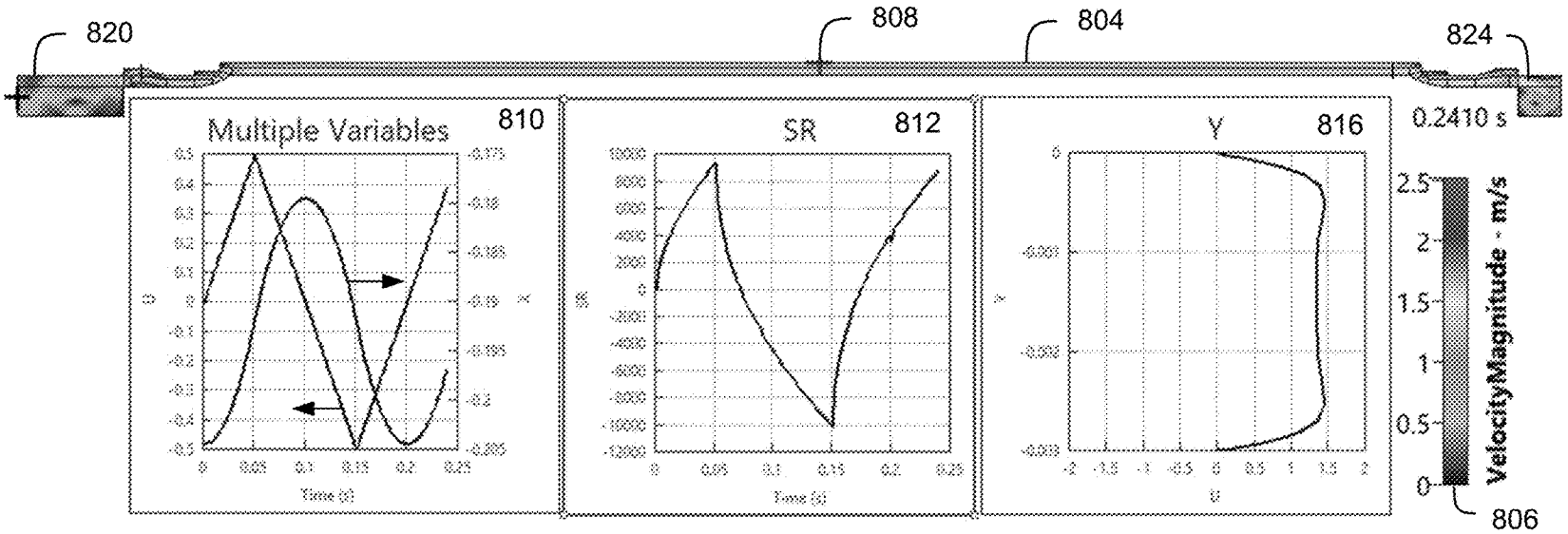

Flow through the substrate processing area was simulated over time. FIG. 8A and FIG. 8B show characteristics of the flow at a particular instant: 0.241 seconds, which is within the second full stroke cycle. The gap between the wafer and the floor is 3 mm. The piston gap is 10 mm. The stroke length for the piston is 25 mm. The frequency of oscillation is 5 Hz. The linear acceleration value is 10 $m/s^2$. The maximum absolute velocity obtained by the moving piston is 0.5 m/s. FIG. 8A and FIG. 8B (and FIGS. 9 and 10) are from numerical models assuming a constant acceleration of the piston rather than the sinusoidal pressure acceleration in the analytic model for FIG. 6 and FIG. 7.

FIG. 8A shows the strain rate as a function of distance across the substrate. The center of the substrate is at x=0 m. FIG. 8A shows that the strain rate is fairly uniform across the center. The strain rate at the edge is not uniform, likely as a result of edge effects including flow jets. No flow is injected into the system, but flow jets arise due to the change in the geometry (contraction followed by expansion) During the transient, there are periods of higher strain rate at the edge of the substrate.

FIG. 8B shows several graphs of flow conditions. Heat map 804 shows the velocity of the flow within the vessel. Velocity is indicated by the color shown in legend 806. The velocity is around 1 to 1.5 m/s in heat map 804. Cross 808 indicates the center of the substrate at X=0 m. Heat map 804 includes flows in a first reservoir 820 and a second reservoir 824. Graph 810 shows velocity (U) and position of the piston X as a function of time in seconds. A positive velocity indicates the piston moving toward the right. Graph 812 shows the instantaneous strain rate (m/s) as a function of time. Graph 816 shows the velocity at different y-positions in the gap beneath the wafer. The peak velocity is actually nearer the upper and lower walls rather than at the center of the gap. This velocity profile may be the result of the oscillating flow.

The numerical flow simulations, including those in FIG. 8A and FIG. 8B showed several flow strain rate improvements. The strain rate profile may be nearly flat over large regions of the wafer, unlike in conventional and other electroplating systems. The pistons can move symmetrically to average out strain rate peaks that may result from systems with a series of agitators. In other systems, agitators may move in a staggered fashion in order to average out the strain rate. For example, an agitator may move 10 mm to the right, then 9 mm to the left, then 10 mm to the right, etc.

Oscillating cross flow may allow for better strain rate uniformity and other advantages over a steady cross flow. The strain rate uniformity is beneficial for plating rate uniformity, enabling alloy plating, and delivering an additive within features. Steady cross flow also may require a large pump capacity whereas oscillating cross flow can be employed using fluid already within the chamber. Oscillating cross flow may help promote flatter bump growth than steady cross flow. In steady cross flow, the diffusion layer thickness can continue to grow along the length of the channel. The diffusion layer thickness does not grow in with oscillating cross flow because of the change in flow direction. A steady cross flow with protuberences may introduce mass-transfer non-uniformities that should be averaged over the whole wafer. The strain rate in an oscillating channel flow varies with time (due to the oscillation), but they may be the same over the whole wafer averaged over time.

A large piston gap and a small wafer gap may enable high strain rates with shorter stroke lengths. The strain rate values may be varied by changing piston acceleration and stroke length. A piston may drive high flow rates during each stroke without using the external plumbing system, including external tanks and pumps.

Figure 9:
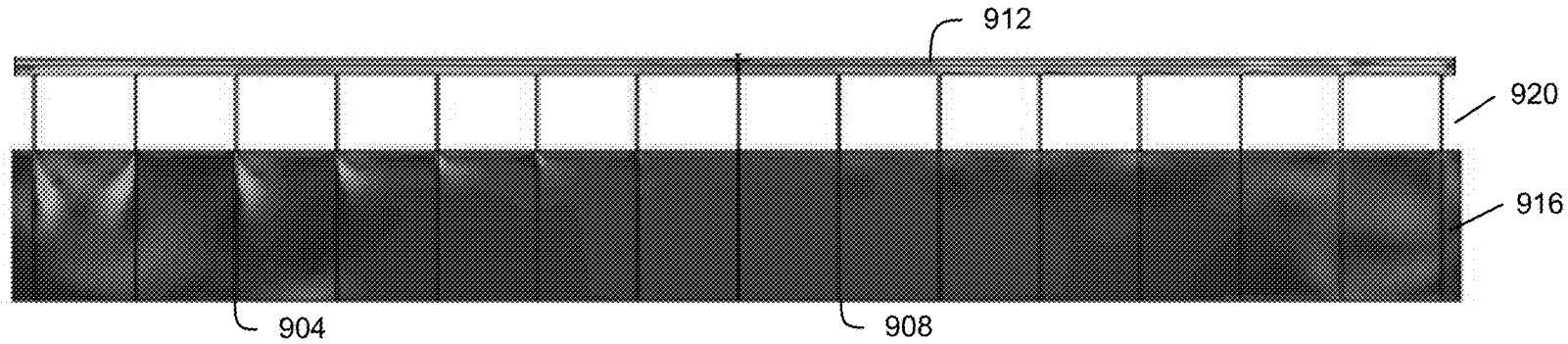
FIG. 9 shows a velocity heat map in a system with dividers according to embodiments of the present technology.

FIG. 9 shows velocity from a simulation of a system having a diffuser 902 with dividers. First divider 904 and second divider 908 are two of the 15 dividers shown. Flow from vessel 912 to a ion reservoir 916 (e.g., an electrolyte plenum below a membrane) may be through diffuser 920. The dividers present communication of flow from vessel 912 to the entire ion reservoir 916. As a result, the flow rate in ion reservoir 916 is near 0 m/s. Without the dividers, the flow rate in ion reservoir 916 may be higher, and as a result, the flow rate within vessel 912 may be reduced for the same piston movement.

Figure 10:
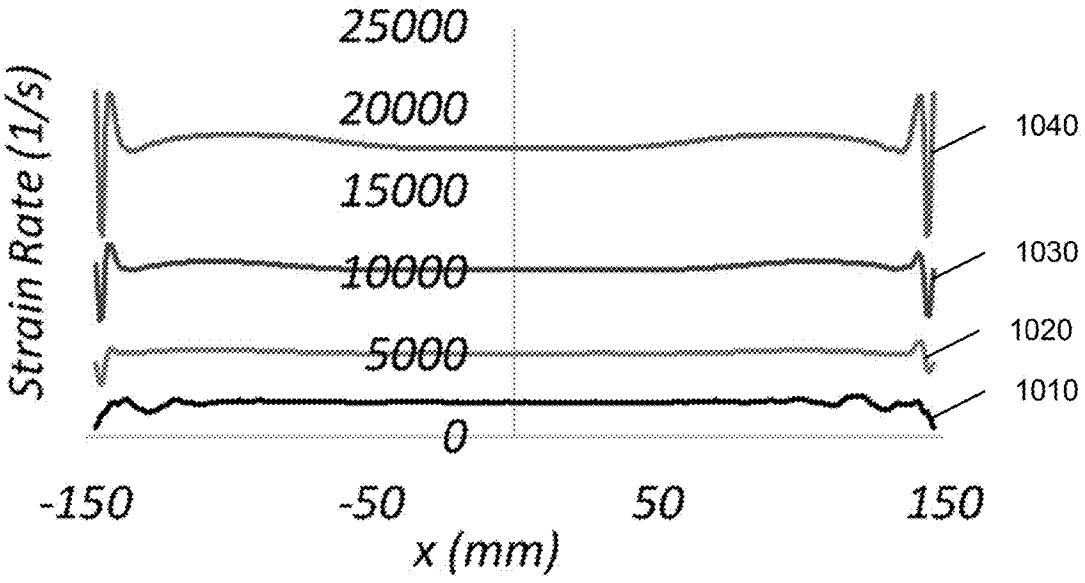
FIG. 10 shows strain rate spatial profiles according to embodiments of the present technology.

FIG. 10 shows the strain rate spatial profiles for different motion settings for a gap between the wafer and the floor of 3 mm. Line 1010 shows using a plurality of paddles to agitate the flow. The frequency of the agitation is 6.67 Hz. The velocity of the paddles is 0.2 m/s. The paddles move in one direction 10.86 mm and in the opposite direction 9.14 mm for each cycle. Lines 1020 to line 1040 are for pistons with an instantaneous piston gap of 10 mm. Line 1020 has a frequency of 5 Hz, a linear acceleration value of 10 $m/s^2$, a velocity of 0.5 m/s, and a stroke length of 25 mm. Line 1030 has a frequency of 7.8 Hz, a linear acceleration value of 25 $m/s^2$, a velocity of 0.8 m/s, and a stroke length of 25.6 mm. Line 1040 has a frequency of 10 Hz, a linear acceleration value of 50 $m/s^2$, a velocity of 1.25 m/s, and a stroke length of 31.25 mm. The piston configurations show higher strain rates than the paddle agitators. In addition, the pistons show a more uniform strain rate across the entire wafer.

The specific details of particular embodiments may be combined in any suitable manner without departing from the spirit and scope of embodiments of the invention. However, other embodiments of the invention may be directed to specific embodiments relating to each individual aspect, or specific combinations of these individual aspects.

The above description of example embodiments of the invention has been presented for the purposes of illustration and description. It is not intended to be exhaustive or to limit the invention to the precise form described, and many modifications and variations are possible in light of the teaching above.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Additionally, details of any specific embodiment may not always be present in variations of that embodiment or may be added to other embodiments.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither, or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a method" includes a plurality of such methods and reference to "the mechanism" includes reference to one or more mechanisms and equivalents thereof known to those skilled in the art, and so forth. The invention has now been described in detail for the purposes of clarity and understanding. However, it will be appreciated that certain changes and modifications may be practice within the scope of the appended claims.

All publications, patents, and patent applications cited herein are hereby incorporated by reference in their entirety for all purposes. None is admitted to be prior art.

What is claimed is:

1. An electroplating system, the electroplating system comprising:

a vessel configured to hold a first portion of a liquid electrolyte;

a substrate holder configured for holding a substrate in the vessel;

a first reservoir in fluid communication with the vessel;

a second reservoir in fluid communication with the vessel;

a first mechanism configured to expel a second portion of the liquid electrolyte from the first reservoir into the vessel; and a second mechanism configured to take in a third portion of the liquid electrolyte from the vessel into the second reservoir when the second portion of the liquid electrolyte is expelled from the first reservoir.

2. The electroplating system of claim 1, wherein:

the second mechanism is configured to expel the third portion of the liquid electrolyte from the second reservoir into the vessel, and the first mechanism is further configured to take in a fourth portion of the liquid electrolyte from the vessel into the first reservoir when the third portion of the liquid electrolyte is expelled from the second reservoir.

3. The electroplating system of claim 2, wherein:

the first mechanism is configured to oscillate between expelling and taking in liquid electrolyte from the first reservoir, and the second mechanism is configured to oscillate between expelling and taking in liquid electrolyte from the second reservoir.

4. The electroplating system of claim 1, wherein:

the first mechanism comprises a first sliding element, the first sliding element is configured to move within the first reservoir, the second mechanism comprises a second sliding element, and the second sliding element is configured to move within the second reservoir.

5. The electroplating system of claim 4, wherein:

a cross-sectional area of the first sliding element is equal to the cross-sectional area of a first space defined by the first reservoir, and a cross-sectional area of the second sliding element is equal to the cross-sectional area of a second space defined by the second reservoir.

6. The electroplating system of claim 1, wherein no mechanisms configured to agitate the liquid electrolyte are disposed within the vessel.

7. The electroplating system of claim 1, wherein when the first mechanism expels the second portion of the liquid electrolyte from the first reservoir into the vessel, no portion of the liquid electrolyte exits the vessel other than to the second reservoir.

8. The electroplating system of claim 1, wherein:

the first mechanism is configured to expel the second portion of the liquid electrolyte in a direction, the first mechanism is configured to move in the direction to expel the second portion of the liquid electrolyte, and the second mechanism is configured to move in the direction to take in the third portion of the liquid electrolyte.

9. The electroplating system of claim 1, wherein:

the first reservoir is characterized by a first cross-sectional area orthogonal to a plane comprising the substrate when the substrate is in the substrate holder, the second reservoir is characterized by a second cross-sectional area orthogonal to the plane, the vessel is characterized by a third cross-sectional area orthogonal to the plane, the third cross-sectional area is less than the first cross-sectional area, and the third cross-sectional area is less than the second cross-sectional area.

10. The electroplating system of claim 1, wherein:

the vessel comprises a seal configured to contact an outer edge of the substrate in the substrate holder, a first section of the vessel comprises the seal and is between the substrate holder and the first reservoir, a second section of the vessel comprises the seal and is between the substrate holder and the second reservoir, a third section of the vessel comprises a floor opposite the substrate holder, the floor being flat in the third section, the third section of the vessel being between the first section and the second section, the first section of the vessel comprises a first channel, the first channel configured such that a cross-sectional area of the first channel orthogonal to flow through the first channel varies no more than 5%, and the second section of the vessel comprises a second channel, the second channel configured such that a cross-sectional area of the second channel orthogonal to flow through the second channel varies no more than 5%.

* * * * *